United States Patent [19]

Mullins, II et al.

[11] Patent Number: 4,610,300

[45] Date of Patent: Sep. 9, 1986

[54] TUBING ACTUATED RETRIEVABLE PACKER

[75] Inventors: Albert A. Mullins, II, Humble; Patrick C. Stone, Houston; Gary D. Ingram, Sugarland, all of Tex.

[73] Assignee: Baker Oil Tools, Inc., Orange, Calif.

[21] Appl. No.: 651,278

[22] Filed: Sep. 14, 1984

[51] Int. Cl.[4] ..... E21B 33/129

[52] U.S. Cl. ..... 166/134; 166/140; 166/217

[58] Field of Search ..... 166/118, 134, 133, 140, 166/209, 210, 138, 216, 217

[56] References Cited

U.S. PATENT DOCUMENTS

| | | | |
|---|---|---|---|
| 3,020,959 | 2/1962 | Nutter | 166/134 |
| 3,412,803 | 11/1968 | Stachowiak | 166/217 |
| 3,623,551 | 11/1971 | Randermann, Jr. | 166/134 |
| 3,749,166 | 7/1973 | Young | 166/134 |
| 4,156,460 | 5/1979 | Crowe | 166/134 |
| 4,176,715 | 12/1979 | Bigelow et al. | 166/140 |
| 4,427,063 | 1/1984 | Skinner | 166/134 |
| 4,437,516 | 3/1984 | Cockrell | 166/134 |
| 4,524,825 | 6/1985 | Fore | 166/140 |

*Primary Examiner*—Stephen J. Novosad
*Assistant Examiner*—Bruce M. Kisliuk
*Attorney, Agent, or Firm*—Norvell & Associates

[57] ABSTRACT

A packer apparatus for use in a subterranean well comprises an inner mandrel and means for applying tension to the inner mandrel to set radially expandable slips and packing elements. The mandrel can be releasably positioned in a first position to secure the slips and packing element in the retracted position and can be shifted to a second position in which engagable lock segments secure the slips and packing element in expanded configuration. The packer can be released by rotational manipulation or by axial force. The packer apparatus can be used with rotationally manipulatable well tools positioned either above or below the packer apparatus.

50 Claims, 11 Drawing Figures

TUBING ACTUATED RETRIEVABLE PACKER

BACKGROUND OF THE INVENTION

1. Field of the Invention

This invention relates to well packers used in subterranean oil or gas wells and more specifically to retrievable well packers and well tool assemblies which can be set and released by manipulation of a tubular string, including application of a tensile or compressive force through the tubing string to set or release the packer.

2. Description of the Prior Art

Conventional packers used to seal the annulus between a tubing string and the casing in a subterranean oil or gas well can either be permanent packers or retrievable packers. Retrievable packers are intended to be lowered into the well bore and set at some desired downhole location to isolate the annular areas above and below the packer and between the inner and outer conduit during certain downhole operations. Retrievable packers, like permanent packers, employ a sealing or packing element to form the annular seal engaging both the casing and sealing along the exterior of the tubing string. Although not essential for simpler packers, more complex packers also employ means to anchor the packer in engagement with well casing. Conventionally, radially expandable anchoring slips having an exterior surface suitable for gripping the well casing are employed with more complex retrievable packers. Depending upon the conditions to be encountered in the subsurface well, packers may employ anchoring slips capable of holding the packer in place against only upwardly directed forces. Conversely, packers may employ anchoring slips capable of holding the packer in place against downwardly directed surfaces. However, in all but the simpler applications, packers must be anchored against forces acting in opposite directions. In many conventional retrievable packers, anchoring slips are expanded radially outwardly by oppositely facing expanders or cones or wedges which are axially shiftable to engage the lower surface of the anchoring slips. In conventional packers, means have been provided for expanding the packing element simultaneously with the expansion of the anchoring slips or expanding the packing before or after actuation of the anchoring slips.

Conventional retrievable packers and similar downhole tools can be actuated by fluid pressure, by wireline or by manipulation of the tubing string. Hydraulic or hydrostatic retrievable packers are commonly used in deviated wells where tubing manipulation cannot be reliably transmitted to the packer apparatus. Either rotational or longitudinal manipulation has been employed to set retrievable packers. Some retrievable packers have employed a combination of rotational and longitudinal manipulation or longitudinal force applied through the tubing string to set a packer. For example, the retrievable packer disclosed in U.S. Pat. No. 3,507,327 employs rotational manipulation and compressive force or set-down weight to maintain the packer in a set configuration. Other conventional packers, such as the model "AD-1" tension set packer shown on page 845 of the 1982–83 Composite Catalog of Oil Field Equipment And Services published by World Oil are set in response to a tensile force applied through the tubing.

In addition to merely manipulating the packers between a retracted and an expanded set configuration, longitudinal forces or stresses applied to the packer can be significant in maintaining an adequate seal over the life of the packer. Extrusion of the packing element can result in a loss of the longitudinal compressive stress necessary to maintain proper squeeze on the packing elements and a proper wedging action to the anchoring slips in expanded configuration. Therefore, it is desirable either to maintain a continuous axial force or stress on the packing element and slip assembly or to provide means for intermittently applying longitudinal stress to the packer assembly. In actual oil field operations, it is often simpler to apply a tensile force to the packing element, since adequate compressive forces may be difficult to apply.

Among the applications for which retrievable packers are employed are for production, water flooding, high pressure fracturing, acidizing, pumping, disposal, testing stimulation, workover or other operations. Use of packers in these operations impose certain performance requirements upon retrievable packers, as well as requirements imposed by various regulatory authorities. For example, regulatory authorities may require that a retrievable packer be capable of holding a prescribed pressure from both directions to provide an adequate safety margin. Furthermore, the use of other equipment with a packer, especially in view of the few ways in which downhole tools can be actuated, may impose further restrictions. For example, the use of a downhole shutoff valve, such as that disclosed in U.S. Pat. Nos. 4,270,606 or in 4,458,751 requires that rotational manipulation be transferred to a valve incorporated in the tubing string. The valves disclosed in those patents are actuated by rotational manipulation of the tubing string. Normally a packer is used to provide a reaction force to permit relative rotation between various components of the valves. It follows that only packers which can be set and released in a compatible manner can be used with valves of this type.

While numerous packers having one or a portion of capabilities of the tension set neutral packer disclosed in this application is known, none has all of the capabilities of the device disclosed herein.

SUMMARY OF THE INVENTION

A packer apparatus for use in establishing sealing integrity between an inner conduit, such as a tubing string, and an outer conduit, such as a well casing, in a subterranean well is attached to the inner conduit in a conventional manner. The packer apparatus has a longitudinally extending mandrel which can be threaded directly to a tubular member forming a portion of the tubular conduit or which can be threaded to a separate downhole tool, such as a downhole shutoff valve, also forming a portion of the inner conduit. In the preferred embodiment of this invention, the mandrel comprises an inner mandrel and an intermediate mandrel extending therearound over at least a portion of the length of the inner mandrel. One or more packing elements and conventional anchoring slips capable of resisting forces in opposite directions, are disposed in surrounding relationship to the mandrel. Shiftable expanders or cones engage the anchoring slips upon relative longitudinal movement to expand the slips. Relative axial movement of the shifting components of the packer also imparts a compressive force to the packing elements to extend the packing elements into engagement with the outer conduit or casing.

In the preferred embodiment of this invention, a control sleeve surrounds a portion of the inner mandrel and, in a first retracted position, the control sleeve engages both the inner mandrel and the outer shiftable components of the packer apparatus to prevent outward expansion of the packing elements and the anchoring slips. This control sleeve is disengagable with the inner mandrel to permit radial expansion of the slips and the packing elements. In the preferred embodiment of this invention, the control sleeve is disengaged from the inner mandrel by rotation of the inner mandrel. Locking segments are provided in engagement with the control sleeve for engaging the mandrel upon expansion of the packing element and the anchoring slips to hold the shifting components of the packer apparatus in the set position. In the preferred embodiment of this invention, the locking segments engage the control sleeve and are shiftable into engagement with the intermediate mandrel upon expansion of the anchoring slips and the packing element. In the preferred embodiment of this invention, the locking segments are shiftable from a disengaged position when the packing elements and slips are retracted to a position engaging the intermediate mandrel when the packing elements and slips are expanded.

The packer apparatus can be used with rotationally manipulatable well tool, such as a downhole shutoff valve, which can be located either above or below the packer apparatus. The inner mandrel is selectively shiftable between a position in which the inner mandrel is rotatable relative to the set anchoring slips and packing element and a position in which the inner mandrel is fixed relative to the set anchoring slips and packing element. Separate means are provided to permit rotational release of the packer apparatus or to permit an emergency longitudinal release. The packer apparatus described herein is resettable and can be sequentially set at various longitudinal positions within a well bore.

DETAILED DESCRIPTION OF THE PREFERRED EMBODIMENT

Figure 1A:
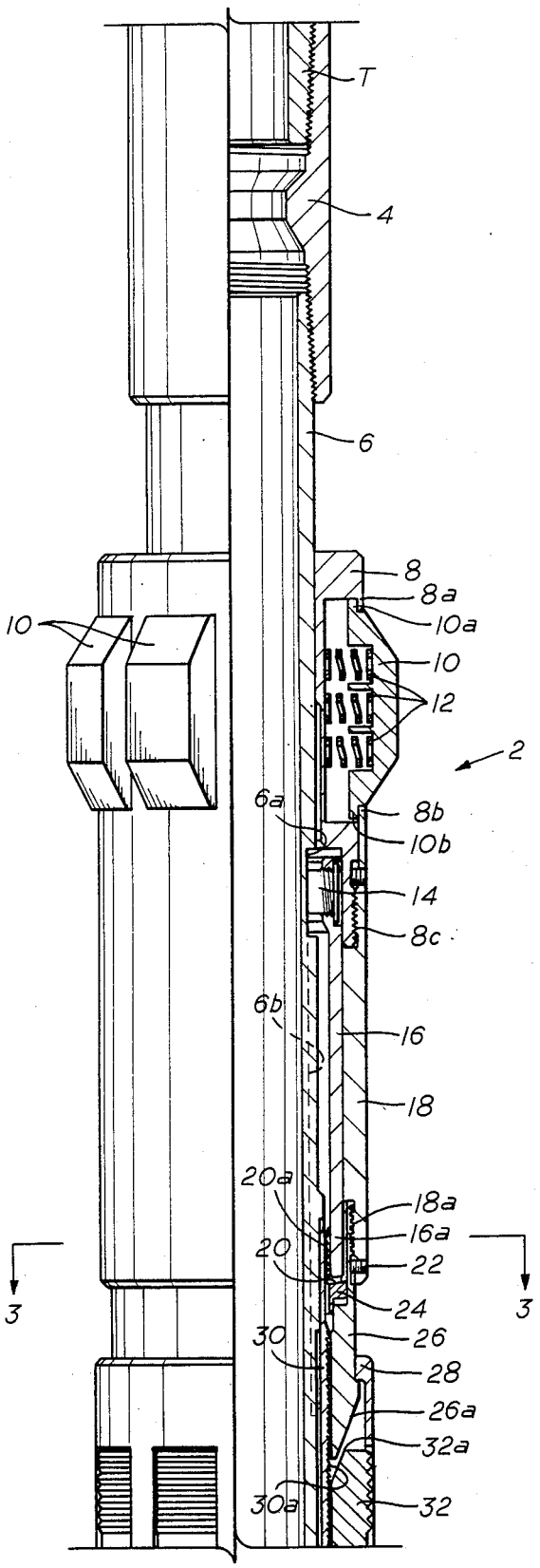
FIGS. 1A and 1B show the packer apparatus in the retracted configuration.
Figure 1B:
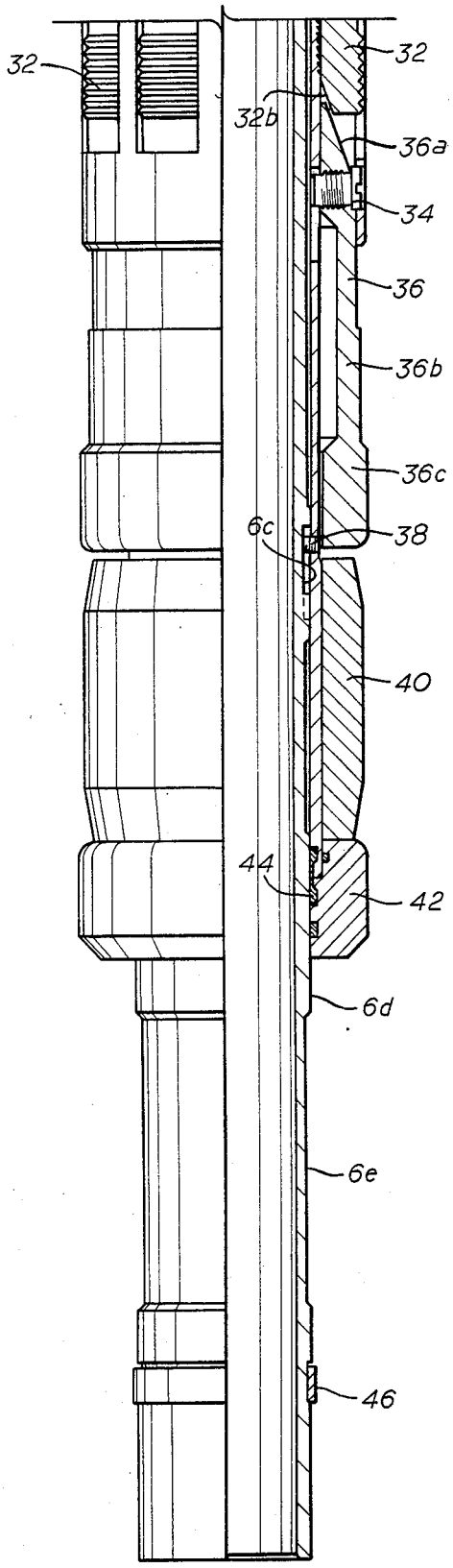

As shown in FIG. 1, the packer apparatus 2 is attached to a conventional tubing string T by means of a conventional coupling 4 having threads at either end for engaging both the tubing T and the upper end of the packer inner mandrel 6. As shown in FIG. 1, inner mandrel 6 comprises a tubular member extending along the entire length of the packer apparatus. Although the packer inner mandrel 6 has threaded connections only at its upper end, as shown in FIG. 1, it should be understood that a conventional threaded connection to an extension of the inner tubular conduit T can be provided at the lower end of inner mandrel 6. The inner mandrel 6 is surrounded by a drag block housing 8 containing a plurality of individual drag block segments 10 adjacent the upper end of the mandrel. Expandable anchoring slips 32 engageable with oppositely facing expander or cone members 26 and 36 are positioned below the drag block housing 8. As shown in FIG. 1B, a single annular packing element 40 is located below the anchoring slips 32 adjacent the lower end of the packer apparatus 2. The drag block assembly consisting of the drag block housing 8 and drag block segments 10, the anchoring slips 32, the upper and lower expanders 26 and 36 and the packing element 40 are all positioned in surrounding relationship to inner mandrel 6.

The individual drag block segments 10 are received within openings extending the drag block housing 8. Lips **10*a* and 10*b* located at either end of the individual drag block segments engage a corresponding lip adjacent the ends of the openings through the drag block housing 8 to retain the drag block segments 10 within the drag block housing. In the preferred embodiment of this invention, the drag blocks 10 are spring biased by a plurality of coil springs 12 acting between the inner portion of the drag block housing and the drag block segments 10. Springs 12 act to urge the drag block segments 10 radially outward. The drag block segments 10 thus are normally retained in a radially expanded condition with the drag blocks 10 comprising the radially outermost elements of the packer apparatus 2, at least when packer apparatus is in the retracted configuration as shown in FIGS. 1A and 1B. Adjacent the lower end of the drag block housing 8, a standard threaded connection 8*c* is formed on the outer surface thereof with an axially extending upper housing sleeve 18, which comprises a tubular component of the packer apparatus 2. Upper housing sleeve 18 is in turn joined by means of threads 18*a* to an upper cone or wedge shaped member 26. Drag block housing 8, upper housing sleeve 18 and upper cone or expander 26 thus form a unitary assembly which can be held in position by engagement between the drag block segments 10 and the outer casing in the manner shown in FIG. 2B. Engagement of the drag blocks 10 with the casing thus causes the assembly of drag block housing 8, upper housing sleeve 18 and upper expander cone 26 to resist either longitudinal or rotational movement of the remaining elements of the packer apparatus 2. In the position shown in FIG. 1A, this assembly consisting of the drag block housing 8, the upper housing sleeve 18 and the upper expander cone 26 is rotatable relative to the inner mandrel 6**.

Figure 5:
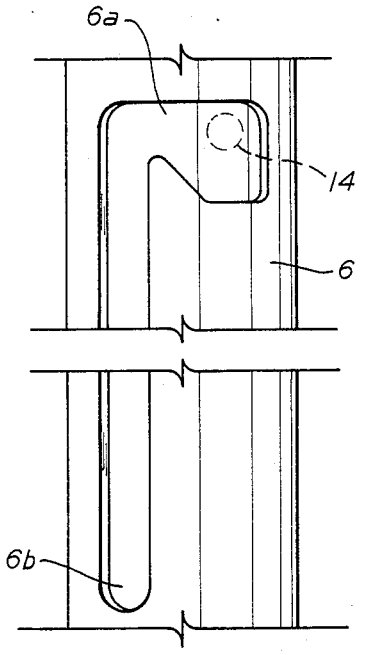
FIG. 5 is a view of the slot on the inner mandrel engageable with a pin on the control sleeve.

Adjacent to and spaced from the upper end of the inner mandrel 6 is a slot configuration generally in the shape of a J, as shown in FIG. 5, is defined. This J-slot has an upper circumferentially extending portion **6*a* and a lower longitudinally extending portion 6*b* contiguous therewith. As shown in FIG. 1A, a cylindrical or tubular control sleeve 16 is located between the inner mandrel 6 and the upper housing sleeve 18 in the vicinity of the J-slot defined by grooved portions 6*a* and 6*b*. The control sleeve 16 has a radially inwardly extending J-pin 14 secured at its upper end by means of conventional threads. In the configuration shown in FIG. 1A, the pin 14 is positioned to engage the upper partially circumferentially extending portion 6***a* of the J-slot defined on the exterior of the inner mandrel 6. The J-pin 14 occupies the position represented by the dashed lines in FIG. 5 when the packer apparatus 2 is in the position shown in FIG. 1A.

Figure 3:
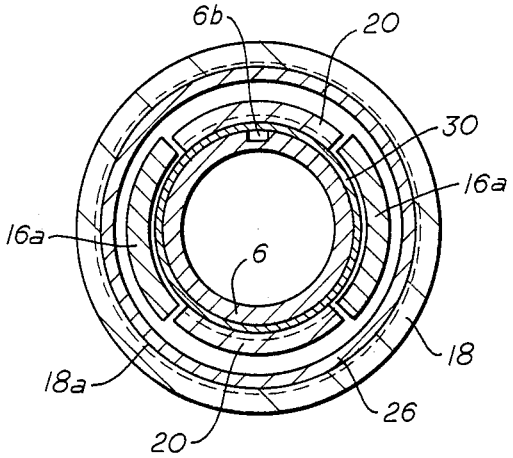
FIG. 3 is a cross-sectional view of the interengagement of the locking segments and the control sleeve taken along section lines 3—3 shown in FIG. 1A.

A plurality of individual locking or stop segments 20 having a ratcheting threaded profile 20*a* located on the inner circumference is positioned at the lower end of control sleeve 16. In the preferred embodiment of this invention, two locking segments 20 are employed. Each of these two locking segments 20 extend around an arc of substantially 90°. The locking segments 20 are held in engagement with the lower end of the control sleeve 16. In the preferred embodiment of this invention, two interengaging arcuate fingers are defined in the lower end of control sleeve 16 defining two arcuate recesses for engagement with segments 20. Interengagement between the locking segments 20 and the lower fingers 16*a* of the control sleeve 16 is shown in the cross-sectional view of FIG. 3. When the J-pin or stop member 14 is in engagement with the partially circumferentially extending portion 6*a* of the J-slot on the exterior of the inner mandrel 6, as shown in FIG. 1A, the locking segments 20 are located adjacent the smooth exterior surface of the mandrel assembly and do not engage the mandrel assembly to prevent movement of the control sleeve relative to the mandrel assembly. At such time the locking segments 20 are contracted and do not engage the casing C for positively locating the assembly in place.

The mandrel assembly is formed of both the inner mandrel 6 and an intermediate mandrel 30 extending circumferentially around the inner mandrel 6 over a portion of the length thereof adjacent the central and lower portion of the mandrel 6. Intermediate mandrel 30 comprises a tubular member having an inner diameter substantially equivalent to the outer diameter of the inner mandrel 6. In the configuration shown in FIGS. 1A and 1B, the intermediate mandrel 30 is free to rotate relative to the intermediate mandrel 6. Adjacent the upper end of inner mandrel 30, a series of ratcheting threads 30*a* adapted for interengagement with the threads 20*a* on the inner circumference of locking segment 20 are located below the position of the locking segments 20 in the retracted position shown in FIG. 1A. Ratcheting threads 30*a* have a profile which permits longitudinal movement of the control segments downwardly therepast, but prevents longitudinal movement of the threads 20*a* upwardly without rotation. Rotational movement of locking segments 20 relative to ratcheting threads 30*a* would permit upward movement of the locking segments 20 and disengagment of locking segments 20 from the ratcheting threads 30*a*. Thus the thread profile is such that the inner mandrel 6 can be moved longitudinally upwardly relative to the assembly comprising drag block 8, upper housing sleeve 18 and upper expander cone 26, but downward movement of the inner mandrel 6 relative to the assembly held in position by the expanded drag block segments 10 can be achieved only by relative rotational movement.

A plurality of anchoring slips 32 are located below the upper expander cone 26 and are held within a slip cage 28. Slip cage 28 engages the upper cone 26 in the configuration of FIG. 1A by means of interengaging lips located along the mating surfaces thereof. A lower expander cone 36 is located below the anchoring slips 32. Lower cone 36 has an upwardly facing inclined surface 36*a* adjacent the lower end of the anchoring slips 32 in the same manner as upper cone 26 has a downwardly facing inclined surface 26*a* adjacent the upper end of slips 32. Inclined portions 32*a* and 32*b* located on the inner surface of anchoring slips 32 adjacent the upper and lower ends respectively, are provided for cooperable engagement with expander cone surfaces 26*a* and 36*a*. The lower expander cone assembly comprises an axially extending cylindrical portion 36*b* along the intermediate portion thereof and an enlarged abutting shoulder or abutment 36*c* located at the lower end thereof. Lower expander cone 36 is secured against rotational movement with respect to intermediate mandrel 30 by means of a torque pin 34 extending thereto into a slot on the exterior of the inner mandrel 30. Thus torque pin 34 engages the intermediate mandrel, the lower cone 36, the slip cage 28 and, in turn, the anchoring slips 32 to prevent rotation of the slip assembly relative to the intermediate mandrel 30.

In the preferred embodiment of this invention, a single packing element 40 comprising an elastomeric material of conventional construction is located adjacent the lower end of the intermediate mandrel 30. Although not shown in FIG. 1B, the conventional packing element 40 may have conventional relief grooves defined in the inner surface thereof to permit radial expansion of the packing element 40 in such a manner as to provide appropriate sealing engagement with the casing C. A lower abutting ring 42 is located at the lower end of packing element 40. Lower abutting ring 42 engages the lower axial end of packing element 40 in the same manner that the lower section 36*c* of the lower cone engages the upper end of the packing element 40. Enlarged ring sections 36*c* and 42 are adapted to apply axially compressive loads to cause radial expansion to the packing element 40.

Figure 6:
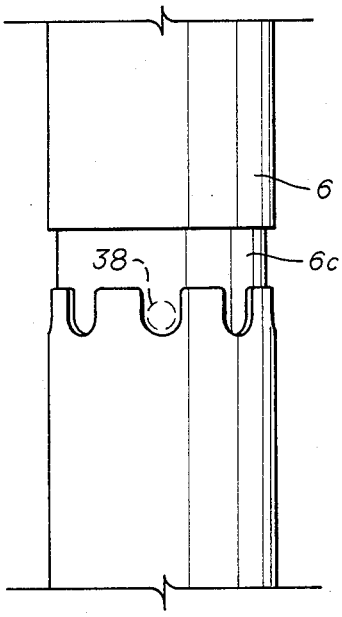
FIG. 6 is a view of the antirotation groove in the inner mandrel engageable with a pin secured to the intermediate mandrel.
Figure 7:
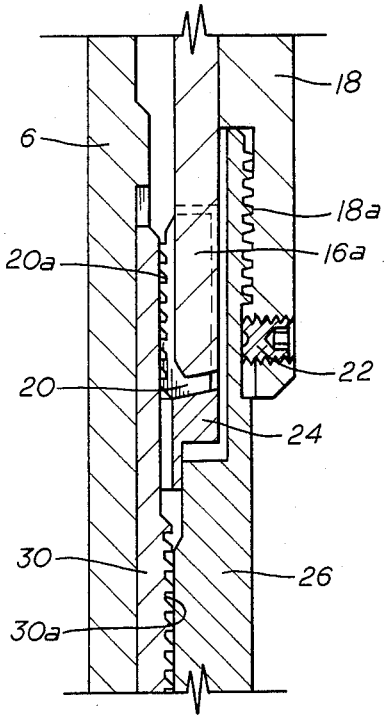
FIG. 7 is a sectional view of the locking members and the control member.
Figure 8:
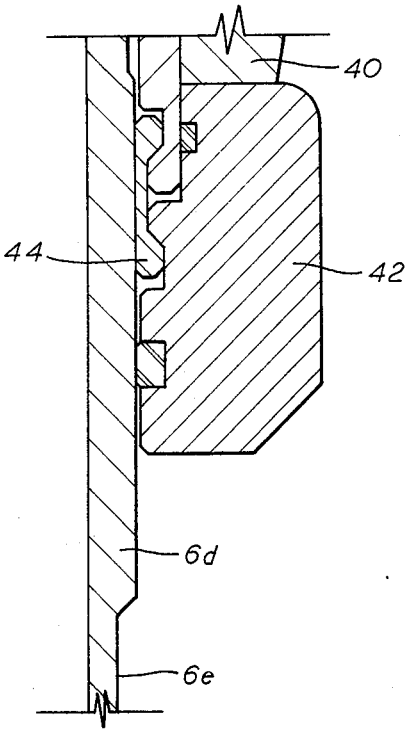
FIG. 8 is a sectional view showing the releasable engagement between the mandrels and the lower abutting ring.

In the preferred embodiment of this invention, a groove 6*c* having an upper circumferentially continuous portion and lower circumferentially discontinuous contiguous portion is defined on the exterior of the inner mandrel 6. This antirotation slot 6*c* is shown in FIG. 6. This slot can be located at any position along the inner mandrel 6 between the upper and lower ends of the intermediate mandrel 30. A frangible pin 38 secured to the intermediate mandrel 30 is located in the antirotation slot 6*c*. In the configuration shown in FIG. 1B, the pin 38 is located in the upper circumferentially continuous portion of the antirotation slot 6*c*. In the configuration shown in FIG. 2C, the pin 38 is located in one of the circumferentially discontinuous portions along the lower end of slot 6*c*. The position of pin 38 in the configuration shown in FIG. 2C is shown by the dashed lines on FIG. 6. When pin 38 is located in the circumferentially continuous slot 6*c*, the inner mandrel 6 can be rotated relative to the intermediate mandrel 30. When the pin 38 is received within one of the circumferentially discontinuous portions along the lower end of slot 6*c*, as shown in FIG. 6, the inner mandrel cannot be rotated relative to the intermediate mandrel 30 and to the slips and packing element assembly without shearing the pin 38.

The lower cylindrical abutting ring 42 is held in engagement with the longitudinally adjacent cylindrical intermediate mandrel 30, in the configuration of FIGS. 1A and 1B, by means of a radially biased inwardly collapsible resilient interconnecting C-ring 44 having an enlarged cross-sectional area at each end. The enlarged or thicker portion at the upper end of C-ring 44 fits within a cooperating groove on the interior of the intermediate mandrel 30. The enlarged portion of the C-ring 44 at the lower end fits within a similar groove located on the interior of abutting ring 42. In the preferred embodiment, C-ring 44 is a biased spring metal member. In the configuration shown in FIGS. 1A and 1B, the resilient C-ring 44 is held in a radially expanded configuration by a radially enlarged section **6*d* of the laterally adjacent inner mandrel 6. The lower abutting ring 42 is located in surrounding relationship to the enlarged section 6*d* of the inner mandrel in the retracted configuration of FIGS. 1A and 1B and in the expanded configuration of FIGS. 2A, 2B and 2C. In the expanded configuration of FIGS. 2A, 2B and 2C the resilient packing element is compressed and the tensile forces in intermediate mandrel 30 and abutting ring 44 keep the interconnecting ring in tension. Immediately adjacent the enlarged section 6*d* of inner mandrel is an axially extending radially recessed portion 6*e*. A pickup ring 46 is located in surrounding relationship to the lower end of the mandrel 6 below the recessed portion 6*e***.

Figure 2A:
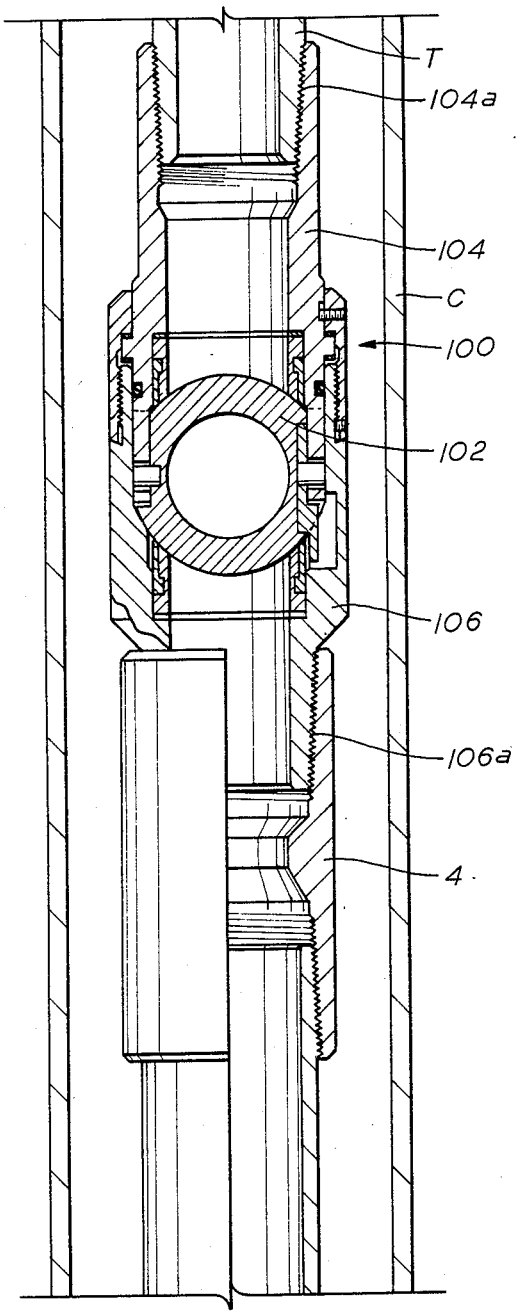
FIGS. 2A, 2B and 2C show the packer apparatus in a set configuration within a well casing in which the packer apparatus is attached to a rotationally manipulatable valve located above the packer apparatus in the tubing string.
Figure 2B:
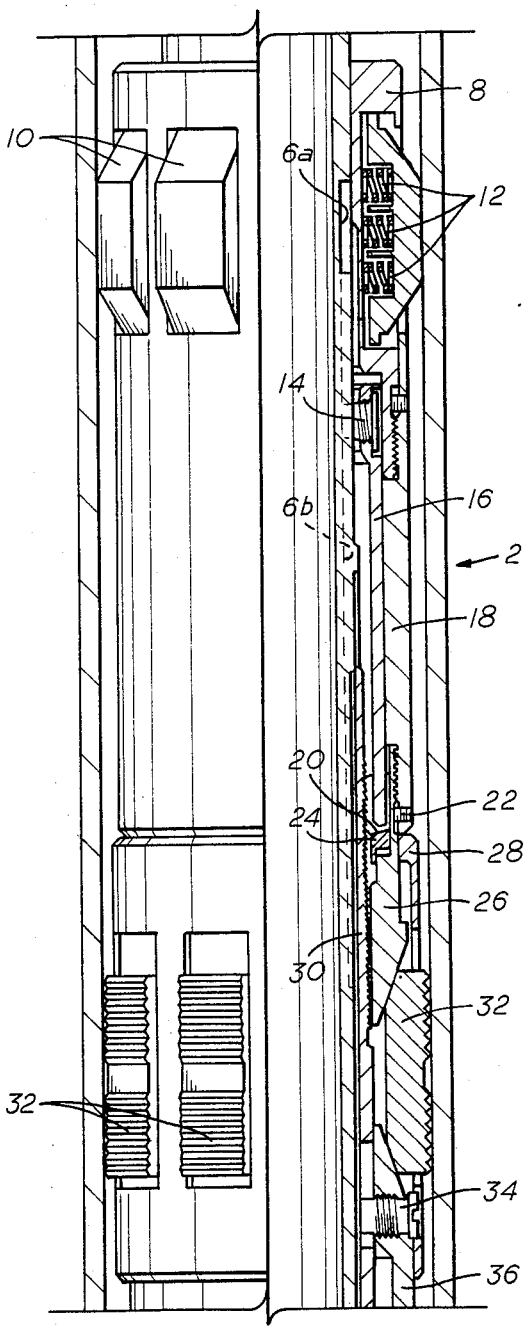
Figure 2C:
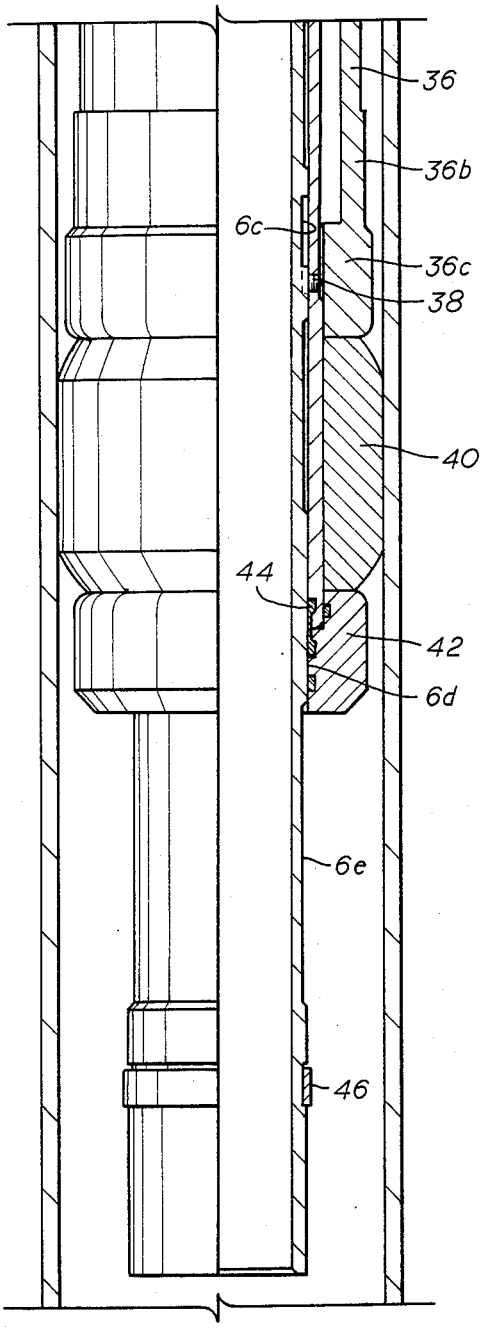

FIGS. 2A, 2B and 2C differ from FIGS. 1A and 1B in two respects. FIGS. 2A, 2B and 2C show the packer apparatus 2 in the expanded or set configuration with the packing element 40 and the anchoring slips 32 in engagement with the casing C shown in FIGS. 2A, 2B and 2C. FIGS. 1A and 1B show the packer in its retracted configuration. Casing C is not shown in FIGS. 1A and 1B. FIG. 2A also shows the packer apparatus 2 attached to a downhole shutoff valve 100 at its upper end rather than directly to the tubing T. In FIG. 2A, the downhole shutoff valve is attached to the tubing T at its upper end and comprises a portion of the tubular string to which the packer apparatus 2 is attached. The downhole shutoff valve 100, shown in FIG. 2A, comprises a valve closure member in the form of a rotatable ball member which has a flow passageway extending therethrough. This flow passageway can be aligned with the bore of the tubing when the valve is in the open configuration and can be positioned at an angle of 90° when the tubing T is to be closed above the packer apparatus 2. The downhole shutoff valve 100 comprises a housing having an upper section 104 joined to the tubing T by means of threads **104*a* and a lower section 106 joined to the packer coupling 4 by means of threads 106*a*. The upper portion of the valve housing 104 is rotatable through an angle of at least 90° with respect to the lower portion of the housing 106. Rotation of the upper housing 104 relative to the lower housing 106 imparts rotation to the ball valve element 102 about an axis transverse to the axis of the tubing T and transverse to the axis of the inner mandrel 6 of the packer apparatus 2. Operation of the downhole shutoff valve depicted in FIG. 2A is described in more detail in U.S. Pat. No. 4,421,171, incorporated herein by reference. Although the valve 100 is attached at the upper end of packer apparatus 2 in FIG. 2A, the valve apparatus could also be attached to the inner mandrel 6 or tubing extending below the packer apparatus 2**.

OPERATION

The preferred embodiment of the invention disclosed herein comprises a tension set packer which can be considered neutral, in the sense that no longitudinal force need be applied to inner mandrel 6, when the packer is in the set configuration shown in FIGS. 2A, 2B and 2C. The packer is tension set in that the packer is set by applying a tensile or upwardly directed load to the tubing T which is transmitted to the packer apparatus through inner mandrel 6.

The packer apparatus 2 can be inserted into the casing C of a subterranean well in the retracted position shown in FIGS. 1A and 1B. In the retracted configuration, the anchoring slips 32 and the packing element 40 are in the radially retracted position and can be held out of engagement with the casing C. The only portion of the packer apparatus 2 which engages the casing C in the configuration of FIGS. 1A and 1B are the drag block segments 10 which exert a frictional force tending to retard movement of the packer apparatus longitudinally or rotationally relative to the casing C. In the configuration of FIG. 1A, the J-pin 14 is located in the upper section **6*a* of the J-slot and prevents relative longitudinal movement between the inner mandrel 6 and the drag assembly consisting of drag block housing 8, drag blocks 10, upper housing sleeve 18, and the upper expander cone 26. The remaining portion of the packer apparatus 2, in surrounding relationship to inner mandrel 6, is held against downward motion relative to the inner mandrel 6 by abutment of a shoulder on the inner mandrel with the upper end of the intermediate mandrel 30. The lower portion of the surrounding packer assembly is held against upward movement by abutment of the torque pin 34 in a slot on the inner mandrel 30 and by the abutment of the components thereof with the upper cone 26**.

When the packer apparatus 2 has reached its desired position with the casing C of the well bore, the anchoring slips 32 and the packing element 40 are expanded outwardly into engagement with the casing C. In order to expand the anchoring slips 32 and the packing element 40, the control sleeve 16 must first be disengaged from the inner mandrel 6 by moving pin 14 into alignment with the longitudinally extending portion **6*b* of the J-slot. In this position, the inner mandrel 6 can be shifted upwardly and relative movement occurs between the shiftable drag assembly and inner mandrel 6. Since the control sleeve 16 is in engagement with the shiftable drag block assembly through inwardly biasing ring 24 in engagement with the lock segments 20, the J-pin shifts into the longitudinally extending portion 6*b* of the slot. Upward movement of the inner mandrel 6 is trahsmitted through pin 38 to the intermediate mandrel 30. Upward movement of the intermediate mandrel 30 in conjunction with inner mandrel 6 is transmitted through collapsible C-ring 44 to the lower abutment ring 42. Upward movement of the packing element 40 is in turn transmitted through the abutment portion 36*c* of the lower cone 36. The anchoring slips 32 are expanded radially by the engagement between inner surface 32*a* with mating cooperating expander surface 26*a*. The engagement between surfaces 36*a* and 32*b*, causing expansion of the anchoring slip 36, firmly anchors the packer apparatus against further upward movement relative to the casing C. The lower expander cone 36 then moves into anchoring engagement with the anchoring slips 32 as surface 26*a* engages surface 32*a*** to firmly anchor the apparatus against downward movement.

During expansion of the anchoring slips 32 and the packing element 40, the lock segment 20 has shifted downwardly relative to the inner mandrel 6 and relative to the intermediate mandrel 30. Lock segments 20, biased inwardly by camming ring 24 in engagement with the cone 26, shifts into a position intermediate the ends of the ratcheting threads 30*a*. The locking threads 20*a* on the interior of lock segments 20 engage ratcheting segments 30*a* to prevent upward movement of the upper cone 26 relative to the intermediate mandrel 30. Securing the upper cone 26 relative to the intermediate mandrel 30 in this manner also secures the upper cone 26 relative to the lower cone 36 and the lower abutment ring 42 thus preventing retraction of either the anchoring slips 32 or the packing element 40. Sufficient tensile force applied to mandrel 6 through tubing T thus firmly anchors the packer apparatus 2 in sealing engagement with casing C.

It should be noted that the lock segments 20 engage the threads 30*a* on the intermediate mandrel 30 sufficiently to permit relative movement of the inner mandrel 6 relative to the intermediate mandrel 30 and relative to the remainder of the packer apparatus. Such relative movement is, however, limited by the axial extent of the antirotation slot 6*c*. When the antirotation pin 38 is located within the circumferentially continuous portion of the antirotation slot 6*c*, the inner mandrel can rotate relative to the packer apparatus. When the pin 38 moves into the circumferentially discontinous portion at the lower end of slot 6*c*, see FIG. 6, the inner mandrel cannot rotate relative to the intermediate mandrel 30 nor relative to the packer apparatus. It will of course be understood that rotation of the mandrel in one direction cannot occur after the packer is set since the lock segments 20 have reached the extent of their travel relative to ratcheting threads 30*a* when the slips are expanded. The lock segments 20 are then forced against the casing C to prevent rotation in one direction, and any longitudinal movement is also prevented. Rotation of the mandrel in the opposite direction would not be prevented. Furthermore, the upper movement of the inner mandrel 6 is limited in its extent by the antirotation pin 38 in the position shown in FIG. 6. With the antirotation pin at the lower end of the antirotation slot 6*c*, additional tensile force can be applied to the expanded packing element 40 and expandable anchoring slips 32, thus permitting the operator to "cinch up" the packer in the event of relaxation of the components of the packer apparatus 2 from the position shown in FIGS. 2A, 2B and 2C.

The ability to selectively position the inner mandrel 6 in a position permitting rotation and, alternatively, in the position preventing rotation relative to the anchored packer apparatus is significant with reference to manipulation of other downhole tools, such as the valve 100. With the antirotation pin located in the circumferentially discontinuous portion of the antirotation slot 6*c*, as shown in FIGS. 2A, 2B and 2C, rotation imparted to the tubing string T will result in relative rotation between the upper valve housing element 104 and the lower valve housing element 106 to shift the valve closure member 102. If the valve member 100 were located at the lower end of the packer apparatus 2, the valve could be rotated between the open and closed position by locating the inner mandrel 6 such that the antirotation pin 38 would be in the circumferentially continuous portion of the antirotation slot 6*c*.

The packer apparatus 2 can be released from the expanded configuration shown in FIGS. 2A, 2B and 2C and shifted to another position within the well. Release of this resettable packer merely requires appropriate rotation of the tubing string T to disengage the threads 20*a* located on the interior of lock segments 20 from the ratcheting threads 30*a*. Since the torque pin 34 is located in a longitudinally extending slot 6*b* when the packer apparatus is in the set configuration, rotation of the tubing T transmitted to the mandrel 6 and through pin 14 to the control sleeve 16 will disengage the lock segments 20 from the intermediate mandrel ratchet threads 30*a*. Such rotation of the matching threads will permit the upper cone 26 to be shifted upwardly from beneath the anchoring slips 32. A downward force applied to the inner mandrel 6 to the intermediate mandrel 30 through a shoulder thereon with the upper end of the intermediate mandrel will urge lower abutting ring 42 downwardly to permit the packing element to retract and to withdraw the lower expander cone 36 from beneath the slip 32. Packer apparatus 2 can then be moved longitudinally within the well bore to a position above the initial setting point or to a position below the initial setting point. At this point, the packer can be set in the same manner as described previously.

Figure 4:
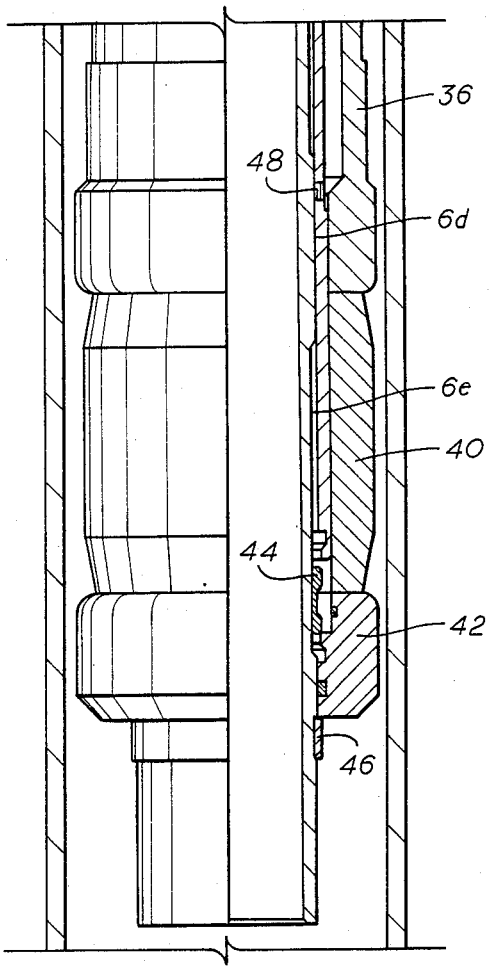
FIG. 4 is a view of a portion of the packer apparatus showing the released configuration adjacent the packing element.

If for some reason the packer apparatus cannot be disengaged by rotational manipulation in the manner just described, a second or emergency release mechanism is provided. Antirotation pin 38 is fabricated of a material which is frangible and which can be dimensioned to carry a desired and specified shear load. By applying tension to the inner mandrel 6 in excess of the tension required to set the packer by some prescribed amount, the antirotation pin 38 can be sheared permitting upward movement of the inner mandrel 6 relative to the intermediate mandrel 30 and relative to the collapsible ring 44. Movement of the raised surface 6*d* from beneath the inwardly biased resilient ring 44 will permit the ring 44 to collapse inwardly into the recess 6*e*. When the ring 44 collapses inwardly into recess 6*e*, the engagement of the inner mandrel 30 with the lower abutment ring 42 through collapsible ring 44 is removed and the lower abutment ring 42 can move downward as shown in FIG. 4. The packing element 40 can thus collapse allowing the cone 36 to shift downwardly from beneath the slips. Continued upstrain on the inner mandrel will then pull the upper cone 26 from beneath the anchoring slips 26 to permit the slips to fully retract thus permitting complete retrieval of the packer apparatus 2 from the well.

Although the packer can be released by applying a tensile force to the mandrel 6 to shear the antirotation pin 38, this shearable emergency release is not affected by the pressure of fluids in the annular zone between the tubing and casing above the expanded packing elements. This fluid pressure load is not applied to the shear pin 38. Instead, this fluid pressure load is supported by the slips 32 and lower slip expander 36. The hydrostatic fluid pressure load in the annulus above the expanded packing element is carried by the packer subassembly consisting of the slip 32 interconnected through lock segments 20 to intermediate mandrel 30 and in turn to lower cylindrical abutment ring 42 below the expanded packing element (see FIGS. 2A, 2B and 2C). The shear pin 38 is not subjected to this hydrostatic pressure force.

Although the invention has been described in terms of the specified embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a packer apparatus for use in establishing sealing integrity between upper and lower zones in an annular area between an inner and outer conduit in a subterranean well, comprising:

an inner mandrel attachable to the inner conduit;

anchoring slip means engagable with the outer conduit for holding the packer in engagement with the outer conduit against oppositely directed forces;

packing element means engagable with the outer conduit for sealing against fluid pressure acting thereon in the upper and lower zones;

shearable means for retaining the anchoring slip means and packing element means in engagement with the outer conduit, the shearable means being sheared by application of a force to the inner mandrel for releasing the anchoring slip means and the packing element means from engagement with the outer conduit; the improvement comprising;

means for supporting forces acting on the packer due to the pressure of fluid in the upper zone without subjecting the shearable means to forces due to the pressure of fluid in the upper zone.

2. In the apparatus of claim 1 wherein the means for supporting forces due to the pressure of fluid in the upper zone comprises a cylindrical intermediate mandrel encircling at least a portion of the inner mandrel attachable to the anchoring slip means, extending through the packing elements means and attachable to a cylindrical abutting ring engagable with the lower end of the packing element means when the anchoring slip means and packing element means are in engagement with the outer conduit.

3. In the apparatus of claim 2 wherein the shearable means engages the inner mandrel and the intermediate mandrel.

4. In the apparatus of claim 3 wherein the intermediate mandrel is attachable with the anchoring slips upon manipulation of the mandrel.

5. In the apparatus of claim 4 wherein the intermediate mandrel is attachable to the anchoring slips by longitudinal manipulation of the mandrel and is disengagable from the anchoring slip means upon rotation of the inner mandrel.

6. In the apparatus of claim 5 further comprising control means shiftable between first and second positions by manipulation of the inner mandrel, the control means comprising means for preventing expansion of the anchoring slip means and packing element means into engagement with the outer conduit in the first position and means for preventing retraction of the anchoring slip means and packing element means from engagement with the outer conduit in the second position.

7. The apparatus of claim 6 further comprising at least one lock member engagable with the control means and shiftable into engagement with the intermediate mandrel upon longitudinal manipulation of the inner mandrel, the lock member and the control means attaching the anchoring slips to the intermediate mandrel, the lock member being disengagable from the intermediate mandrel upon rotation of the inner mandrel transmitted to the lock member through the control means.

8. In the apparatus of claim 7 further comprising an interconnecting ring between the longitudinally adjacent intermediate mandrel and the abutting ring, the interconnecting ring contacting the exterior of the inner mandrel and being radially held in engagement with the intermediate mandrel and the abutting ring by the inner mandrel.

9. In the apparatus of claim 8 wherein the inner mandrel is shiftable relative to the interconnecting ring upon shearing of the shearable means to disengage the inner mandrel from the intermediate mandrel.

10. In the apparatus of claim 9 wherein the interconnecting means is inwardly biased, the inner mandrel having a recessed surface on the exterior thereof shiftable beneath the interconnecting means when the shearable means is sheared.

11. In the apparatus of claims 1, 2, 3, 4, 5, 6, 7, 8, 9 or 10 wherein the inner mandrel is manipulatable by a tensile force.

12. A packer apparatus for use in establishing sealing integrity between an inner conduit and an outer conduit in a subterranean well, comprising:

a longitudinally extending mandrel attachable to the inner conduit;

packing element means, disposed in surrounding relationship to the mandrel, for sealing the annular area between the inner and outer conduits;

anchoring slip means for securing the packer apparatus in the outer conduit;

shiftable means for expanding the anchoring slip means and the packing element means in response to a longitudinally directed force applied through the mandrel in response to longitudinal movement of the inner conduit;

control means for securing the shiftable means to the mandrel, the control means being releasable from the inner conduit for longitudinal movement relative thereto upon manipulation of the inner conduit;

lock means engagable with the mandrel and the shiftable means, upon release of the control means and upon relative movement between (1) the lock means; and (2) the mandrel and the inner conduit, the anchoring means and packing element means being expanded when the lock means is in engagement with the mandrel; and interengagable means, on the control means engaging the second lock means, for disengaging the second lock means from the mandrel upon manipulation of the inner conduit.

13. The packer apparatus of claim 12 wherein the control means is released from the mandrel upon rotation of the inner conduit.

14. The packer apparatus of claim 13 wherein the control means comprises a pin movable within a J-slot on the inner conduit.

15. The packer apparatus of claim 14 wherein the lock means comprises means engagable with ratcheting threads on the mandrel.

16. The packer apparatus of claim 14 wherein the lock means comprises at least one arcuate segment engagable with the ratcheting threads.

17. The packer apparatus of claim 16 wherein the control means further comprises a longitudinally extending control member to which the pin is attached, the longitudinally extending member being engagable with the lock means, rotation of the inner conduit being imparted to the control means and transmitted to the lock means to disengage the lock means from the mandrel.

18. The packer apparatus of claim 17 wherein the interengagable means comprise at least one arcuate recess defined on the end of the control member, the lock means being received therein.

19. The packer apparatus of claim 13 wherein the lock means comprises means engagable with ratcheting threads on the mandrel.

20. The packer apparatus of claim 12 wherein the shiftable means are shiftable longitudinally relative to the anchoring slip means and the packing element means in response to a tensile force first applied to the inner conduit.

21. A packer apparatus for use in establishing sealing integrity between a well casing and an inner tubular member in a subterranean well having radially expandable slips for anchoring the packer apparatus in the well and at least one radially expandable packing element for establishing sealing integrity in the annulus between the tubular member and the well casing, the improvement comprising:

a longitudinally extending mandrel attachable to the inner tubular member;

inner mandrel means attachable to the inner tubular member, the slips and packing element surrounding the inner mandrel means;

shiftable means for radially expanding the slips and packing element upon longitudinal movement of the shiftable means relative to the inner mandrel means;

control means for controlling relative movement between the inner tubular member and the shiftable means, the control means engaging the shiftable means to prevent substantial relative longitudinal movement therebetween;

a stop member on the control means engagable with the inner tubular member in a first position in which the slips and packing element are retracted to prevent relative longitudinal movement between the control means and the inner tubular member; and a locking member engagable with the control means and with the inner tubular member in a second position in which the slips and packing element are expanded to prevent relative longitudinal movement between: (1) the control means; and (2) the mandrel means and the inner tubular member, the stop member and locking member being disenagable from the mandrel means, by manipulation of the inner tubular member, whereby the packer apparatus is set and released by manipulation of the inner tubular member.

22. The packer apparatus of claim 21 wherein the stop member in the first position and locking member in the second position are disengagable from the mandrel means by rotation of the tubular inner member.

23. The packer apparatus of claim 22 wherein the stop member is engagable with the mandrel means in the second position to prevent relative rotation between at least a portion of the mandrel means and the control means.

24. The packer apparatus of claim 23 wherein the stop member comprises a radially extending control pin received within a slot on the mandrel means, the slot having a first circumferentially extending section for receiving the control pin in the first position and a second longitudinally extending section communicating with the first section for receiving the control pin in the second position.

25. The packer apparatus of claim 24 wherein the locking member comprises at least one segment extending partially around the circumference of the mandrel means and engagable with ratcheting teeth on the exterior of the mandrel means upon relative movement between the control means and the mandrel means from the first position.

26. The packer apparatus of claim 25 wherein the inner tubular member rotates the conduit member, and rotation of the inner tubular member is transmitted through the control pin to the locking member in the second position to disengage the locking member from the ratcheting threads.

27. The packer apparatus of claim 21 further comprising drag means, attached to the shiftable means, for frictionally engaging the casing to retard rotational and longitudinal movement of the shiftable means relative to the casing.

28. The packer apparatus of claim 27 further comprising releasable means for permitting retraction of the slips and packing element with the locking member in engagement with the ratcheting threads.

29. The packer apparatus of claim 21 wherein the mandrel means comprises an inner mandrel and an intermediate mandrel disposed concentrically around the inner mandrel.

30. The packer apparatus of claim 29 wherein the stop member is engagable with the inner mandrel and the locking member is engagable with the intermediate mandrel.

31. The packer apparatus of claim 30 wherein the inner mandrel is selectively rotatable relative to the intermediate mandrel.

32. The packer apparatus of claim 31 further comprising an antirotation pin shiftable between a position preventing rotation between the inner mandrel and the intermediate mandrel and a position in which the inner mandrel is rotatable relative to the intermediate mandrel.

33. The packer apparatus of claim 32 wherein the antirotation pin is frangible.

34. The packer apparatus of claim 33 further comprising an abutment ring engaging one end of the packing element and a collapsable ring engaging the intermediate mandrel and holding the abutment ring fixed to the intermeidate mandrel when the antirotation pin is intact.

35. An assembly including a packer apparatus for use in establishing sealing integrity between a well casing and an inner tubular string in a subterranean well having radially expandable slips for anchoring the packer apparatus in the well and at least one radially expandable packing element for establishing sealing integrity in the annulus between the tubular string and the well casing, the improvement comprising:

an inner mandrel attachable to the inner tubular string, the slips and packing element surrounding the inner mandrel;

shiftable means for radially expanding the slips and packing element upon longitudinal movement of the shiftable means relative to the inner mandrel;

lock means for retaining the slips and packing element in a radially expanded configuration;

antirotation means engagable with the inner mandrel for preventing rotation thereof when the slips and packing element are radially expanded, the antirotation means being disengagable from the inner mandrel upon longitudinal movement of the inner mandrel; and a well tool attachable to the inner tubular string and manipulatable by rotation of the tubular string.

36. The assembly of claim 35 wherein the well tool comprises a valve for opening and closing the tubular string in response to rotation of the tubular string.

37. The assembly of claim 36 wherein the slips and packing element are retractable by rotation of the tubular string upon disengagement of the antirotation means and the inner mandrel, the antirotation means being shiftable for selectively preventing rotation of the tubular string in a direction to disengage the lock means for retraction of the slips and packing element.

38. The assembly of claim 37 wherein the slips and packing element are expandable upon application of a longitudinal force to the inner mandrel.

39. The assembly of claim 38 wherein the antirotation means comprises a radially extending pin shearable upon application of a longitudinal force to the inner mandrel in excess of the longitudinal force for expanding the slips and packing element, the slips and packing element being retractable after the radially extending pin is sheared.

40. The assembly of claim 39 wherein the radially extending pin is received within a slot on the exterior of the inner mandrel, the slot having a first circumferentially continuous portion and an adjacent circumferentially discontinuous portion.

41. The assembly of claim 35 wherein the stop lock means is releasable and reactuatable, whereby the packer apparatus can be set and released a multiple number of times.

42. A cylindrical well tool manipulatable in a well between first and second positions, the well tool comprising: first and second longitudinally adjacent cylindrical members; means subjecting one of the first and second longitudinally adjacent cylindrical members to tension and subjecting the other of the members to compression in oppositely directed longitudinal forces in the first position; an interconnecting member engaging each longitudinally adjacent member in the first position, the interconnecting member being loaded by tensile force in the first position, the interconnecting member being radially biased; a laterally adjacent means radially engaging the interconnecting member and retaining the interconnecting member in a radially extended position in engagement with the first and second longitudinally adjacent cylindrical members in the first position, the laterally adjacent means being shiftable relative to the interconnecting member, the interconnecting member being radially shiftable upon relative movement of the laterally adjacent member to a position disengaged from the longitudinally adjacent cylindrical members, releasing the longitudinally adjacent members whereby the well tool is manipulated from the first to the second position.

43. The cylindrical well tool of claim 42 wherein the interconnecting member comprises a biased spring metal member held in a radially expanded position by engagement with a raised surface on the laterally adjacent member extending therethrough when the well tool is in the first position, the laterally adjacent member comprising a mandrel attachable to a tubular string in the well, the first and second cylindrical members encircling the mandrel, the mandrel being longitudinally shiftable relative to the first and second cylindrical members and the interconnecting member.

44. The cylindrical well tool of claim 43 wherein the mandrel is restrained against longitudinal movement relative to at least one of the cylindrical members when the well tool is in the first position.

45. The cylindrical well tool of claim 43 further comprising a frangible member engaging the mandrel and one of the cylindrical members to restrain the mandrel against longitudinal movement relative to the one cylindrical member, the longitudinal member being disengagable from the one cylindrical member upon application of a predetermined force to the mandrel.

46. The cylindrical well tool of claim 43 wherein the interconnecting member is thicker adjacent longitudinally spaced ends than between the thicker ends, each thicker end engaging one of the longitudinally adjacent cylindrical members.

47. The cylindrical well tool of claim 43 comprising a well packer including expandable anchoring slips and an expandable resilient packing element, the packing element comprising means subjecting the first and second cylindrical members to oppositely directed longitudinal forces.

48. The cylindrical well tool of claim 47 wherein the anchoring slips and packing element are radially expanded in the first position and radially contracted in the second position.

49. In a packer apparatus for use in establishing sealing integrity between upper and lower zones in an annular area between an inner and outer conduit in a subterranean well, comprising:

an inner mandrel attachable to the inner conduit;

anchoring slip means engagable with the outer conduit for holding the packer in engagement with the outer conduit against oppositely directed forces;

packing element means engagable with the outer conduit for sealing against fluid pressure acting thereon in the upper and lower zones;

retaining means for retaining the anchoring slip means and packing element in an engagement position with the outer conduit, the retaining means being releasable by application of a force to the inner mandrel for releasing the anchoring slip means and the packing element means from engagement with the outer conduit; the improvement comprising:

means for positively supporting the said packing element when engaged with the outer conduit against substantial differences in pressure on opposite sides of said packing element without interfering with the engagement position of the retaining means.

50. In a subterranean well tool for use in establishing sealing integrity between first and second portions of an annular area between inner and outer conduits in a subterranean well, comprising:

an inner mandrel in operable communication with the inner conduit;

sealing means selectively engagable with the outer conduit for sealing against fluid pressure acting thereon in the first and second portions;

retaining means for retaining the sealing means in engagement with the outer conduit, said retaining means being placed in a non-retaining position by application of a force to the inner mandrel for releasing the sealing means from engagement with the outer conduit; the improvement comprising:

means for positively supporting the said sealing means when engaged with the outer conduit against substantial pressure differences on opposite sides of said sealing means without interfering with the engagement position of the retaining means.

* * * * *